US006130615A

United States Patent [19]

Poteet

[11] Patent Number: 6,130,615

[45] Date of Patent: Oct. 10, 2000

[54] SWIMMING POOL ALARM SYSTEM

[76] Inventor: Maria Poteet, 560 N. Moorpark Rd., Thousand Oaks, Calif. 91360

[21] Appl. No.: 09/282,256

[22] Filed: Mar. 31, 1999

[51] Int. Cl.[7] ..... G08B 23/00

[52] U.S. Cl. ..... 340/573.6; 340/573.4; 340/556; 340/539; 340/566; 367/118

[58] Field of Search ..... 340/573.6, 573.4, 340/556, 539, 566; 367/118

[56] References Cited

U.S. PATENT DOCUMENTS

| | | | |
|---|---|---|---|
| 3,623,057 | 11/1971 | Hedin | 340/258 |
| 3,688,298 | 8/1972 | Miller et al. | 340/258 B |
| 3,711,846 | 1/1973 | Schlisser et al. | 340/258 |
| 4,121,200 | 10/1978 | Colmenero | 340/539 |
| 4,910,498 | 3/1990 | Feher | 340/556 |
| 5,049,859 | 9/1991 | Arnell | 340/573 |
| 5,195,060 | 3/1993 | Roll | 367/118 |
| 5,828,304 | 10/1998 | Mowday | 340/566 |
| 5,874,889 | 2/1999 | Higdon et al. | 340/426 |

*Primary Examiner*—Daniel J. Wu
*Assistant Examiner*—Tai T. Nguyen
*Attorney, Agent, or Firm*—Goldstein & Canino

[57] ABSTRACT

A swimming pool alarm system including a plurality of motion sensors positioned around a periphery of a swimming pool in a spaced relationship. The plurality of motion sensors generate a sensor beam that extends around the periphery of the swimming pool. An alarm horn is positionable within a house adjacent to the swimming pool. The alarm horn is couplable to an electrical outlet. The alarm horn is in communication with the motion sensors. A portable alarm mechanism is positionable on a body of a pool owner. The portable alarm mechanism is in communication with the motion sensors.

4 Claims, 2 Drawing Sheets

SWIMMING POOL ALARM SYSTEM

BACKGROUND OF THE INVENTION

The present invention relates to a swimming pool alarm system and more particularly pertains to sounding an alarm before a person enters a swimming pool.

Small children drowning in unattended swimming pools has become a very serious problem. Many devices have been suggested to prevent these happenings from occurring. Namely, most swimming pools are know required to have some type of enclosure that surrounds the pool to prevent access to the pool. Further, many pool owners have alarms in connection with their pools. Most of these devices will trigger an alarm once a disruption in the surface of the pool water is sensed. Unfortunately, these devices alert parents and homeowners only after their child or pet has entered into the water thereby making time of the essence in reaching the pool before a drowning occurs.

The present invention seeks to provide a swimming pool alarm that will alert the pool owner before the child or the like enters the water. This will provide more time to avert disaster.

The use of pool alarms is known in the prior art. More specifically, pool alarms heretofore devised and utilized for the purpose of sensing a disruption in a water level in a pool are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, they do not describe a swimming pool alarm system for sounding an alarm before a person enters a swimming pool.

In this respect, the swimming pool alarm system according to the present invention substantially departs from the conventional concepts and designs of the prior art, and in doing so provides an apparatus primarily developed for the purpose of sounding an alarm before a person enters a swimming pool.

Therefore, it can be appreciated that there exists a continuing need for new and improved swimming pool alarm system which can be used for sounding an alarm before a person enters a swimming pool. In this regard, the present invention substantially fulfills this need.

SUMMERY OF THE INVENTION

In the view of the foregoing disadvantages inherent in the known types of pool alarms now present in the prior art, the present invention provides an improved swimming pool alarm system. As such, the general purpose of the present invention, which will be described subsequently in greater detail, is to provide a new and improved swimming pool alarm system and method which has all the advantages of the prior art and none of the disadvantages.

To attain this, the present invention essentially comprises a plurality of motion sensors positioned around a periphery of a swimming pool in a spaced relationship. The plurality of motion sensors generate a sensor beam that extends around the periphery of the swimming pool. The plurality of motion sensors are inconspicuously concealed within planters. An alarm horn is positionable within a house adjacent to the swimming pool. The alarm horn is couplable to an electrical outlet. The alarm horn is in communication with the motion sensors. A portable alarm mechanism is positionable on a body of a pool owner. The portable alarm mechanism is in communication with the motion sensors. The portable alarm mechanism has an auxiliary button in communication with the alarm horn whereby pressing of the auxiliary button will sound the alarm horn.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved swimming pool alarm system which has all the advantages of the prior art pool alarms and none of the disadvantages.

It is another object of the present invention to provide a new and improved swimming pool alarm system which may be easily and efficiently manufactured and marketed.

It is a further object of the present invention to provide a new and improved swimming pool alarm system which is of durable and reliable construction.

An even further object of the present invention is to provide a new and improved swimming pool alarm system which is susceptible of a low cost of manufacture with regard to both materials and labor, and which accordingly is then susceptible of low prices of sale to the consuming public, thereby making such a swimming pool alarm system economically available to the buying public.

Even still another object of the present invention is to provide a new and improved swimming pool alarm system for sounding an alarm before a person enters a swimming pool.

Lastly, it is an object of the present invention to provide a new and improved swimming pool alarm system including a plurality of motion sensors positioned around a periphery of a swimming pool in a spaced relationship. The plurality of motion sensors generate a sensor beam that extends around the periphery of the swimming pool. An alarm horn is positionable within a house adjacent to the swimming pool. The alarm horn is couplable to an electrical outlet. The alarm horn is in communication with the motion sensors. A portable alarm mechanism is positionable on a body of a pool owner. The portable alarm mechanism is in communication with the motion sensors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
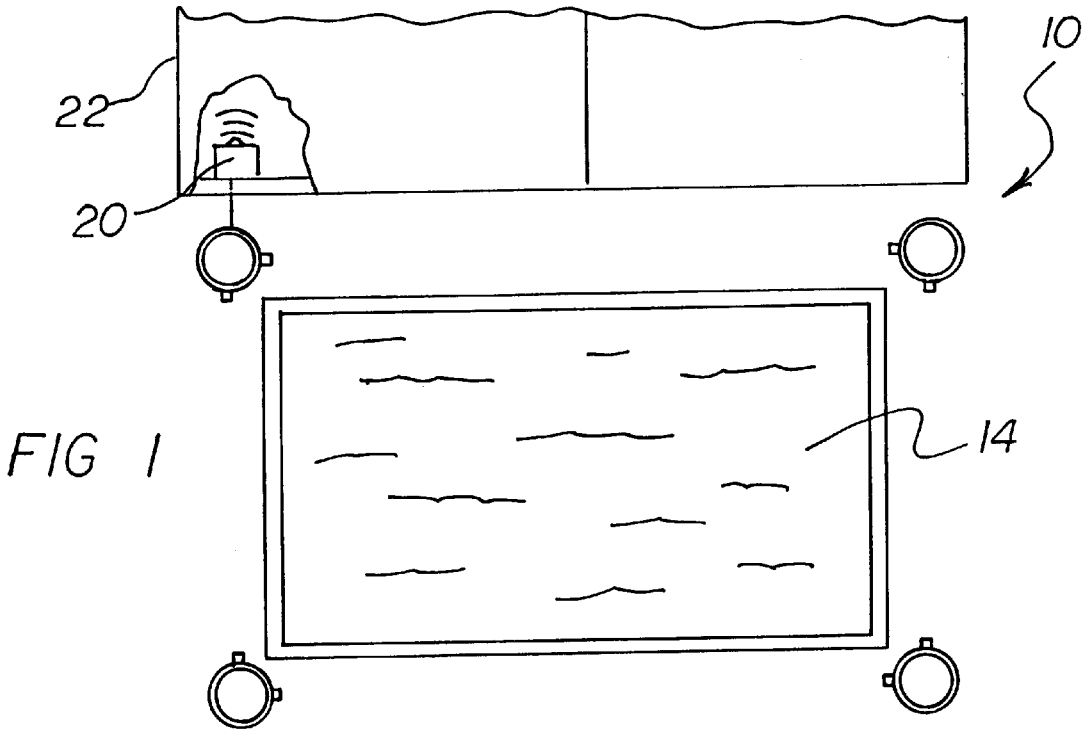
FIG. 1 is a plan view of the preferred embodiment of the swimming pool alarm system constructed in accordance with the principles of the present invention.
Figure 2:
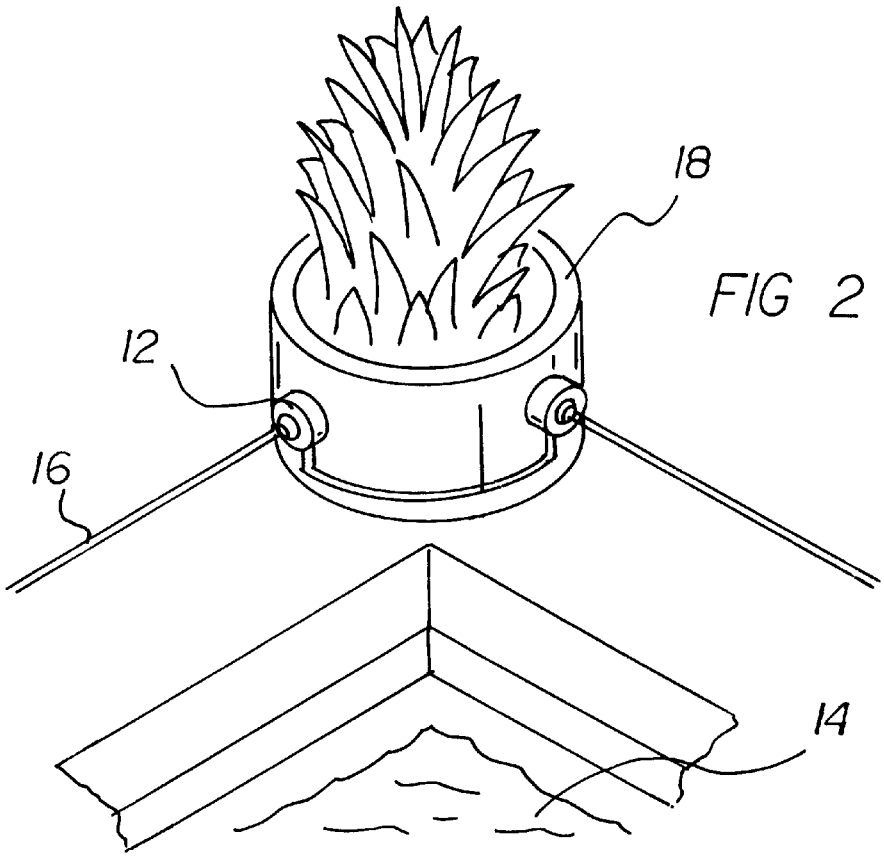
FIG. 2 is a perspective view of one of the motion sensors of the present invention.
Figure 3:
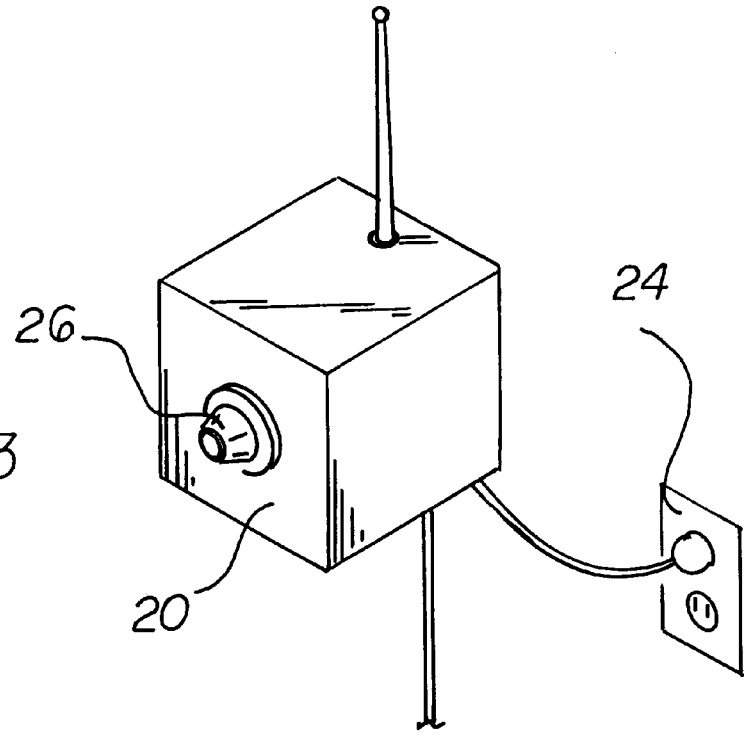
FIG. 3 is a perspective view of the interior alarm mechanism of the present invention.
Figure 4:
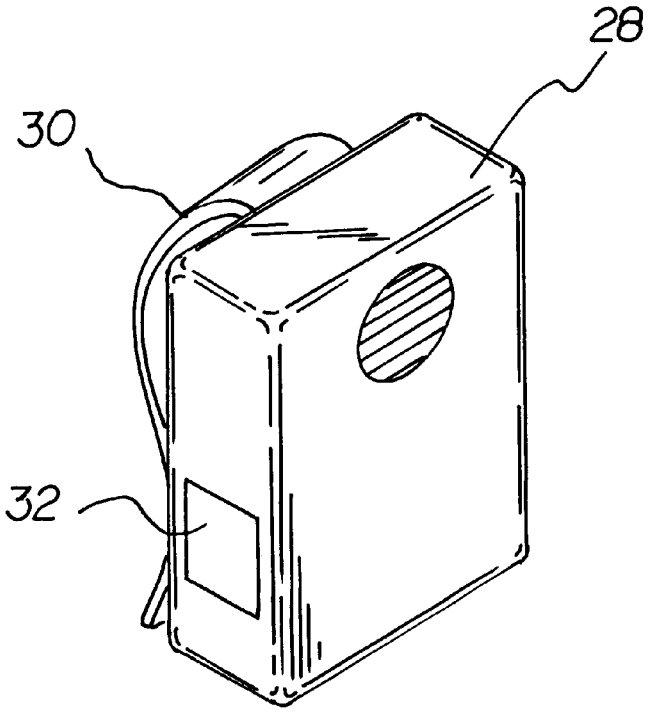
FIG. 4 is a perspective view of the personal alarm mechanism of the present invention.

With reference now to the drawings, and in particular, to FIGS. 1 through 4 thereof, the preferred embodiment of the new and improved swimming pool alarm system embodying the principles and concepts of the present invention and generally designated by the reference number 10 will be described.

Specifically, it will be noted in the various Figures that the device relates to a swimming pool alarm system for sounding an alarm before a person enters a swimming pool. In its broadest context, the device consists of a plurality of motion sensors, an alarm horn, and a portable alarm mechanism. Such components are individually configured and correlated with respect to each other so as to attain the desired objective.

The plurality of motion sensors 12 are positioned around a periphery of a swimming pool 14 in a spaced relationship. Note FIG. 1. The plurality of motion sensors 12 generate a sensor beam 16 that extends around the periphery of the swimming pool 14. The plurality of motion sensors 12 are inconspicuously concealed within planters 18. Note FIG. 2. The motion sensors 12 create the sensor beam 16 that when crossed or disrupted, will create a warning alarm that will alert a pool owner that someone is close to entering into the water. The motion sensors 12 could be concealed within some other type of pool side object that will not obviate their presence.

The alarm horn 20 is positionable within a house 22 adjacent to the swimming pool 14. The alarm horn 20 is couplable to an electrical outlet 24. The alarm horn 20 is in communication with the motion sensors 12. The alarm horn 20 could also be provided with an adjustment dial 26 which will control the level of the volume of the alarm generated.

The portable alarm mechanism 28 is positionable on a body of a pool owner. The portable alarm mechanism 28 is configured to similar to a standard paging device and is provided with a clip 30 to facilitate securement to the body of the pool owner. The portable alarm mechanism 28 is in communication with the motion sensors 12. The portable alarm mechanism 28 has an auxiliary button 32 in communication with the alarm horn 20 whereby pressing of the auxiliary button 32 will sound the alarm horn 20. This action usually will be performed when a person is pool side and a dangerous situation arises and additional assistance is required.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the united states is as follows:

1. A swimming pool alarm system for sounding an alarm before a person enters a swimming pool comprising, in combination:

a plurality of motion sensors positioned around a periphery of a swimming pool in a spaced relationship, the plurality of motion sensors generating a sensor beam that extends around the periphery of the swimming pool, the plurality of motion sensors being inconspicuously concealed within planters;

an alarm horn positionable within a house adjacent to the swimming pool, the alarm horn being couplable to an electrical outlet, the alarm horn being in communication with the motion sensors;

a portable alarm mechanism positionable on a body of a pool owner, the portable alarm mechanism being in communication with the motion sensors, the portable alarm mechanism having an auxiliary button in communication with the alarm horn whereby pressing of the auxiliary button will sound the alarm horn.

2. The A swimming pool alarm system for sounding an alarm before a person enters a swimming pool comprising, in combination:

a plurality of motion sensors positioned around a periphery of a swimming pool in a spaced relationship, the plurality of motion sensors generating a sensor beam that extends around the periphery of the swimming pool;

an alarm horn positionable within a house adjacent to the swimming pool, the alarm horn being couplable to an electrical outlet, the alarm horn being in communication with the motion sensors;

a portable alarm mechanism positionable on a body of a pool owner, the portable alarm mechanism being in communication with the motion sensors.

3. The swimming pool alarm system as set forth in claim 2 wherein the plurality of motion sensors are inconspicuously concealed within planters.

4. The swimming pool alarm system as set forth in claim 2 wherein the portable alarm mechanism has an auxiliary button in communication with the alarm horn whereby pressing of the auxiliary button will sound the alarm horn.

* * * * *